US005209284A

United States Patent [19]

Okamoto et al.

[11] Patent Number: 5,209,284

[45] Date of Patent: May 11, 1993

[54] REDUCED PRESSURE HEAT TREATING DEVICE

[75] Inventors: Masakatsu Okamoto, Kakogawa; Masao Yonemura, Akashi; Hideaki Yumoto, Kakogawa, all of Japan

[73] Assignee: TLV Company, Limited, Hyogo, Japan

[21] Appl. No.: 848,286

[22] Filed: Mar. 9, 1992

[30] Foreign Application Priority Data

| | | | |
|---|---|---|---|
| Apr. 15, 1991 | [JP] | Japan | 3-110880 |
| May 15, 1991 | [JP] | Japan | 3-140928 |
| Jul. 15, 1991 | [JP] | Japan | 3-201283 |
| Jul. 15, 1991 | [JP] | Japan | 3-201284 |
| Sep. 13, 1991 | [JP] | Japan | 3-262832 |

[51] Int. Cl.[5] ..... F25D 13/00; B01J 19/00; C08F 2/00; C08G 85/00

[52] U.S. Cl. ..... 165/32; 165/111; 165/104.27; 165/917; 126/378

[58] Field of Search ..... 165/111, 104.27, 32, 165/96, 917; 126/378

[56] References Cited

U.S. PATENT DOCUMENTS

| | | | |
|---|---|---|---|
| 3,646,992 | 3/1972 | Ishizawa et al. | 165/111 |

FOREIGN PATENT DOCUMENTS

| | | | |
|---|---|---|---|
| 0225580 | 1/1959 | Australia | 165/32 |
| 0202490 | 12/1982 | Japan | 165/111 |
| 0173390 | 10/1983 | Japan | 165/104.27 |
| 63-147614 | 6/1988 | Japan . | |
| 01205886 | 1/1986 | U.S.S.R. | 165/104.27 |

*Primary Examiner*—John K. Ford

*Attorney, Agent, or Firm*—Wegner, Cantor, Mueller & Player

[57] ABSTRACT

A heat treating device used in chemical and food industries, including a heat exchanger of jacket type, for example, which surrounds a reaction vessel, wherein heat media such as steam and water are fed to the heat exchanger and also sucked by sucking means such as an ejector to put the interior of the heat exchanger in a reduced pressure state, thereby effecting heat treatment at relatively low temperature below 100° C., for example, the improvement of which is to prevent variation of the reduced pressure level in the heat exchanger for keeping stability of treating temperature.

4 Claims, 4 Drawing Sheets

REDUCED PRESSURE HEAT TREATING DEVICE

BACKGROUND OF INVENTION

This invention relates to a heat treating device for safely and efficiently heat-treating product to be treated at relatively low temperature such as below 100° C., using reduced pressure steam and/or water as heat media.

In the field of chemical industry and food industry, materials may be treated at relatively low temperature such as about 50° C. for example for the purpose of safety of working and maintenance of product quality. Such a reduced pressure steam heat treating device as disclosed in the Japanese opened patent gazette No. H11-315336 has been proposed for this heat treatment. As shown in FIG. 1, this device includes a reaction vessel 1 for causing materials supplied from an inlet 5 to react as stirring them by a stirrer 7 and delivering reaction product from an outlet 9, a heat exchanger 11 of jacket type having an inlet 13 and an outlet 15 of a heat media such as steam and water and surrounding the vessel 1, a piping 17 for feeding heating steam to the heat exchanger 11 through an automatic valve 19, a suction pump 21 of ejector type having its suction port 23 connected to the outlet 15 of the heat exchanger 11 through a piping 24, a water tank 25 having a diffuser 27 of the ejector 21 connected to its upper space and being provided with level sensors 29*a* and 29*b* and a temperature sensor 31, a piping 33 for feeding cooling water to the water tank 25 through an automatic valve 35, a piping 37 for connecting a lower portion of the tank 25 to a jetting nozzle 41 of the ejector 21 through a pump 39, a piping 43 for connecting the piping 37 to the inlet 13 of the heat exchanger 11 through an automatic valve 45, a draining piping 47 for connecting the piping 43 to the exterior through an automatic valve 49, and a central control unit 51 for receiving signals from the sensors 29*a* and 29*b* and 31 to control the respective automatic valves. When the pump 39 is driven, the water in the tank 25 circulates through the piping 37 and the ejector 21 to maintain the ejector 21 in a sucking state.

When the reaction vessel 1 is heated, the valve 19 is opened and the valve 45 is closed by a signal from the central control unit 51, and heating steam is supplied from the piping 17 to the heat exchanger 11. The steam is sucked by the ejector 21 to enter the water tank 25 together with condensed water, thereby raising the water temperature within the tank 25 gradually. Since the interior of the heat exchanger 11 is put in a reduced pressure state by the ejector 21, saturation temperature of the steam is low and the materials can be caused to react at a temperature below 100° C. In the case of turning from heating to cooling, the valve 19 is closed and the valve 45 is opened by a signal from the central control unit 51, and cool water is supplied into the tank 25, thereby lowering the water temperature within the tank 25 gradually. Thus, the reaction vessel 1 cooled with water whose temperature lowers gradually. The water temperature within the tank 25 is sensed by the temperature sensor 31 and the central control unit 51 responds thereto to control the valve 35, thereby controlling a change of the water temperature in accordance with a predetermined program to control a temperature change of the heat exchanger 11. The level sensors 29*a* and 29*b* sense the upper and lower limit of the water level, respectively, and the central control unit 51 responds thereto to control the valves 35 and 49 for maintaining the water level of the tank 25 substantially constant.

In this prior art device, the temperature difference between the initial cooling water and the heating steam is small at the time of turning from heating to cooling and, therefore, it has such an advantage in that there is no hammering effect caused by thermal shock and a lifetime of the device can be extended.

However, problem exists in that, although the reduced pressure level within the heat exchanger 11 must be precisely controlled for effecting a predetermined temperature control of the heat exchanger 11, water having condensed from the steam within the heat exchanger 11 at the time of heating or remaining therein from evaporation at the time of cooling may pool in the vicinity of the outlet 15 to clog it up, thereby causing variation in the reduced pressure level and, accordingly, in the temperature, which results in variation in the quality of the reaction product. Moreover, it is also a problem in that the water pooling in the vicinity of the outlet 15 actually makes it impossible to lower the heating temperature below 50° C. since it impedes pressure reduction within the heat exchanger 11. Consideration has been given to a branch the piping 24 connect to the upper portion of the heat exchanger 11 for promoting reduction of the pressure, but no actual pressure reducing effect would be gained since the condensed water is sucked preferentially. On the other hand, to control supply of the steam and water so as to prevent the water from pooling is undesirable since it needs a very complicated and expensive control device.

Accordingly, an object of this invention is to provide an improved device which can effect an effective heat treatment at a much lower temperature regardless of the above-mentioned water pooling, by adding a simple improvement to the above-mentioned prior art device.

SUMMARY OF INVENTION

According to this invention, the above-mentioned object can be attained by connecting another sucking means to the upper portion of the heat exchanger of the prior art device to suck the remaining vapor in the upper portion of the heat exchanger aside from the ejector connected to the lower outlet of the heat exchanger.

These and other objects and features of this invention will be described in more detail below with reference to the accompanying drawings.

BRIEF DESCRIPTION OF DRAWINGS

In the drawings.

Throughout the drawings, the same reference numerals are given to corresponding structural components and no description will be repeated thereon.

DESCRIPTION OF PREFERRED EMBODIMENTS

Figure 1:
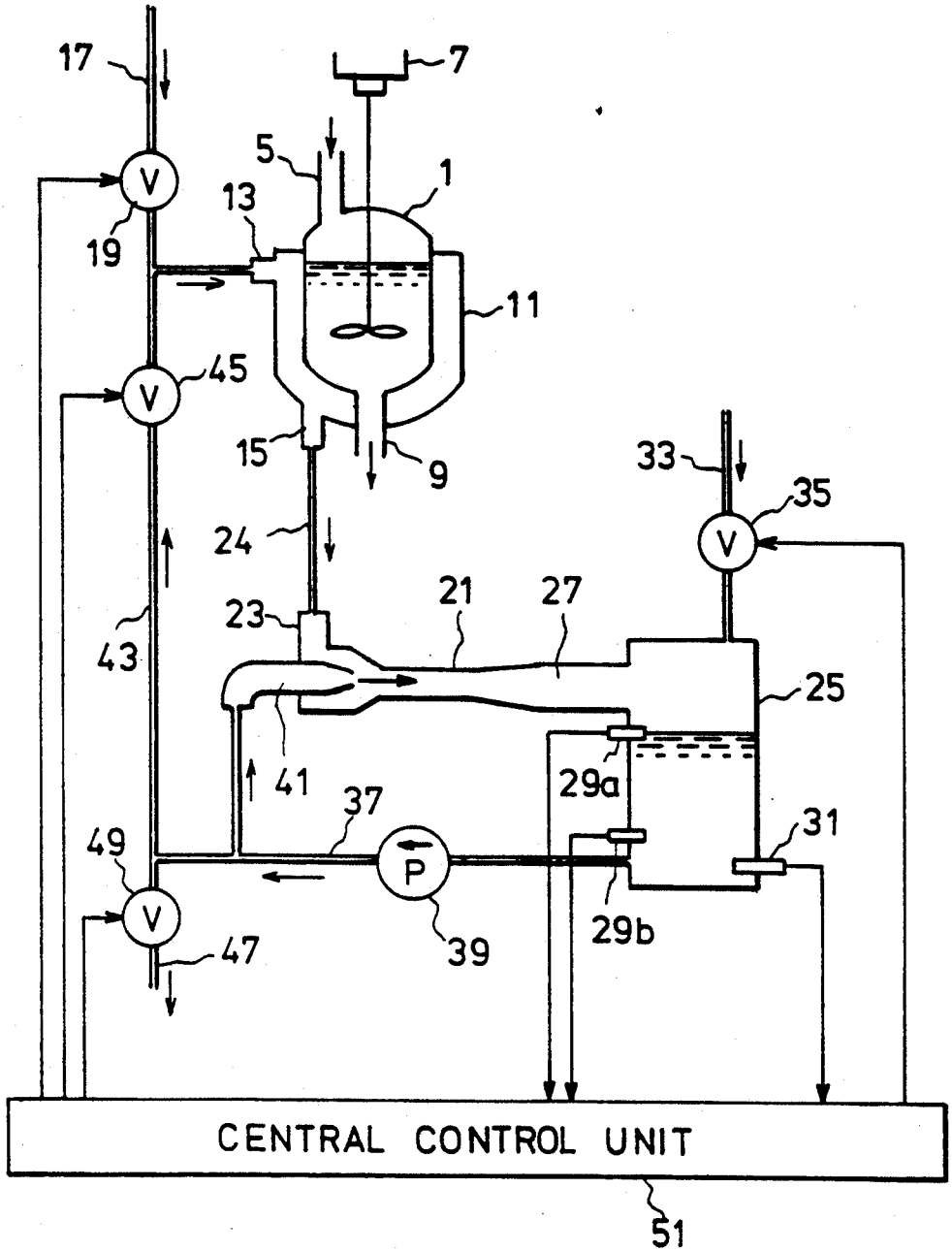
FIG. 1 (PRIOR ART)
FIG. 1 is a schematic view showing a configuration of the reduced pressure heat treating device according to the prior art.
Figure 2:
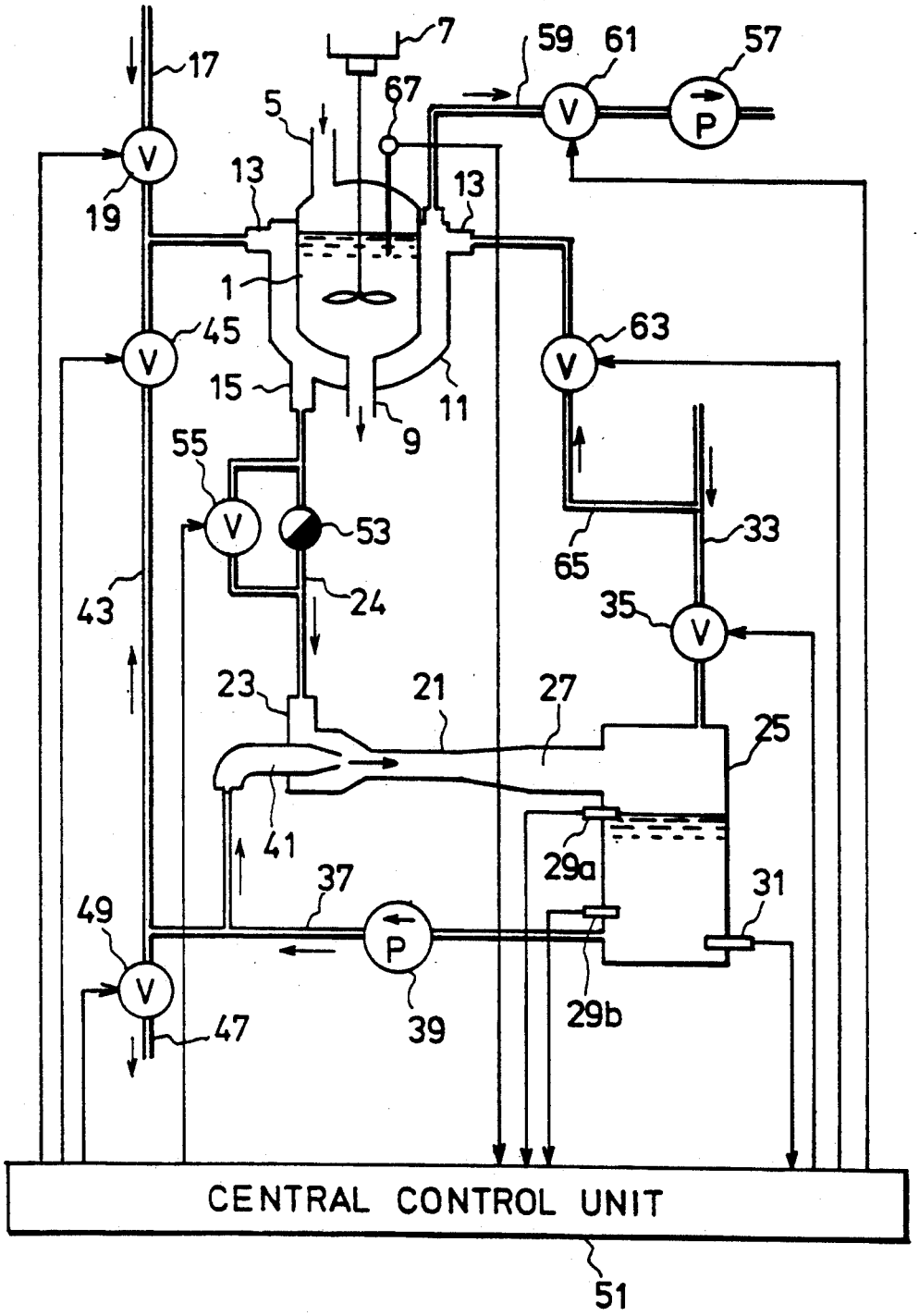
FIG. 2 is a schematic view showing a configuration of an embodiment of the reduced pressure heat treating device according to this invention.

As is understood from FIG. 2 which shows an embodiment of this invention, this embodiment is constructed by adding some components to the prior art device of FIG. 1. Since the same components as shown in FIG. 1 indeed effect substantially same function as described above, the description will not be made on these components but only on the additional components.

More particularly, a steam trap 53 and an automatic valve 55 are inserted in parallel in a piping 24 between a heat exchanger 11 and an ejector 21 and, as a feature of this invention, an evacuation pump 57 is connected through a piping 59 and an automatic valve 61 to a top portion of the heat exchanger 11. An inlet 13 of the heat exchanger 11 is further connected through an automatic valve 63 and a piping 65 to a cooling water supply piping 33. The inlet 53 opens throughout the periphery of the side wall of a reaction vessel 1 so that heat media such as steam and water are distributed uniformly throughout the periphery of its side wall. In addition, the reaction vessel 1 is provided with a temperature sensor 67 whose temperature signal is transferred to a central control unit 51.

The operation of this embodiment is substantially same as that of the prior art device of FIG. 1 if the valve 55 is opened and the valves 61 and 63 are closed. In this embodiment, however, the evacuation pump 57 is driven and the valve 61 is opened appropriately by a command from the control unit 51. Thus, such gases as steam and air within the heat exchanger 11 are discharged through the piping 59 and cooling water and condensed water are sucked by the, ejector 21 to return to a water tank 25 as usual. Thus, the liquids and the gases are discharged through separate paths and, therefore, there is not the problem of the prior art device at all. Accordingly, a sufficient reduced pressure state is obtained in the heat exchanger 11 and it is possible to effect treatment at low temperature such as below 50° C. In this case, it is possible to open the valve 63 to supply cooling water of normal temperatue directly into the heat exchanger 11 since no hammering effect is caused by the cooling water.

When the condensed water is not produced so much in a heating process using steam only, the valve 55 is closed to actuate the steam trap 53. Then, the condensed water is removed here and does not clog up the outlet 15 of the heat exchanger 11 and, therefore, the evacuation pump 57 is no longer needed.

Figure 3:
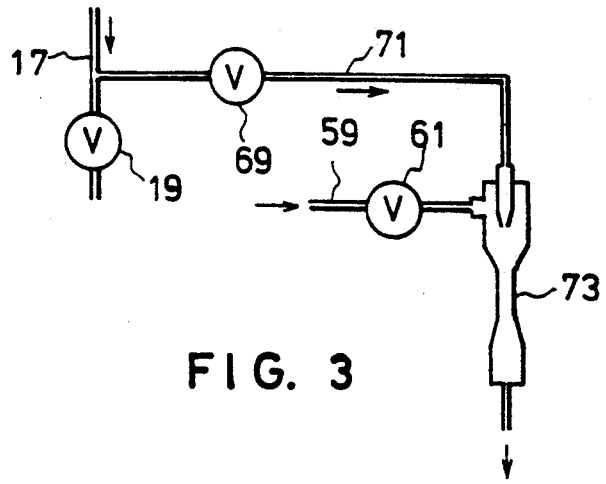
FIGS. 3, 4, 5 and 6 are partial views showing variations of the embodiment of FIG. 2, respectively

While it is possible to use any suitable type of the evacuation pump 57, FIG. 3 shows a variation in which an ejector 73 is used therefor. Since the gas within the heat exchanger 11 is mainly water vapor which may condense upon discharge, the ejector is preferable as the evacuation pump 57. The ejector 73 has its nozzle connected through an automatic valve 69 and a piping 71 to the steam supply piping 17 so as to be driven with steam. Also, it has a diffuser opening to the external air.

Figure 4:
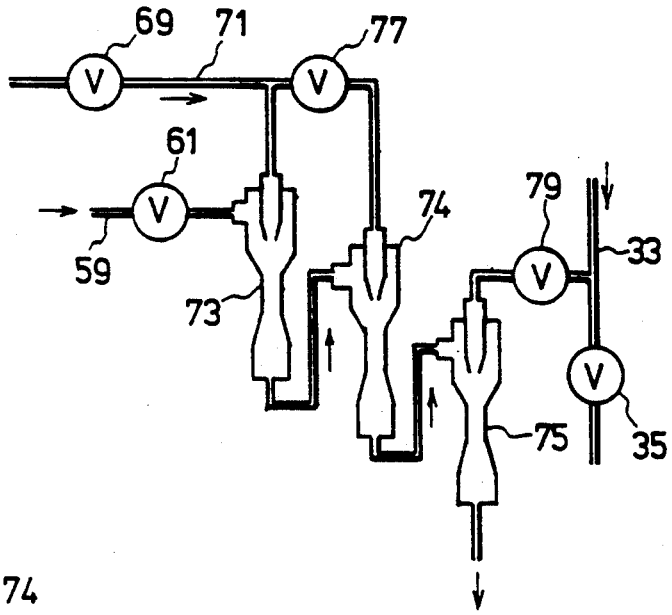

FIG. 4 shows another variation in which two ejectors 74 and 75 are further connected in series to the ejector 73 of FIG. 3 in order to improve its evacuating power. The second ejector 74 has its nozzle connected through an automatic valve 77 to the piping 71 so as to be driven with steam, while the third ejectror 75 has its nozzle connected through an automatic valve 79 to the cooling water piping 33 so as to be driven with water flow. The diffusers of the first and second ejectors are connected respectively to the suction chambers of the succeeding ejectors and the diffuser of the third ejector is opened to the external air.

Figure 5:
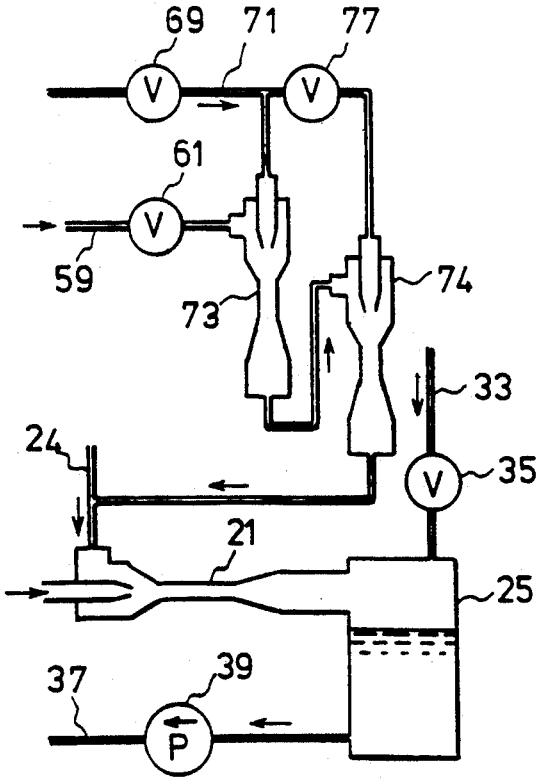

In FIG. 5 which shows a further variation, two series ejectors 73 and 74 are used and the diffuser of the second ejector 74 is connected to the suction chamber of the liquid sucking ejector 21 together with the piping 24 from the outlet of the heat exchanger 11, to recover condensation. Such recovery of condensation is often important when the heat medium is a substance other than water.

Figure 6:
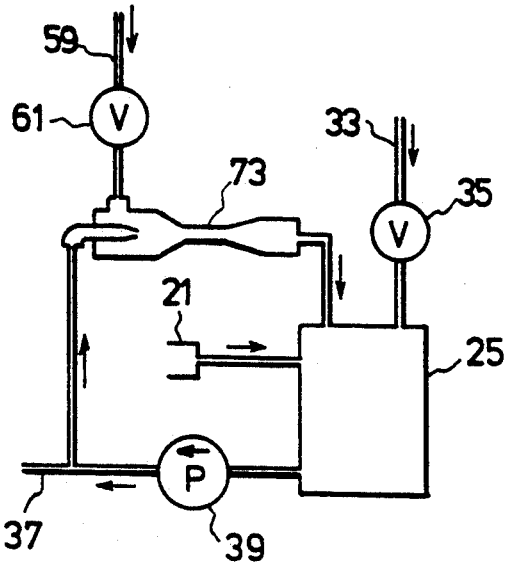

In the variation of FIG. 6, the nozzle of the ejector 73 of FIG. 3 is connected to the outlet of the pump 39, thereby driving the ejector 73 with output fluid of the pump 39. The diffuser of the ejector 73 is connected to the tank 25 for recovering the driving fluid.

Figure 7:
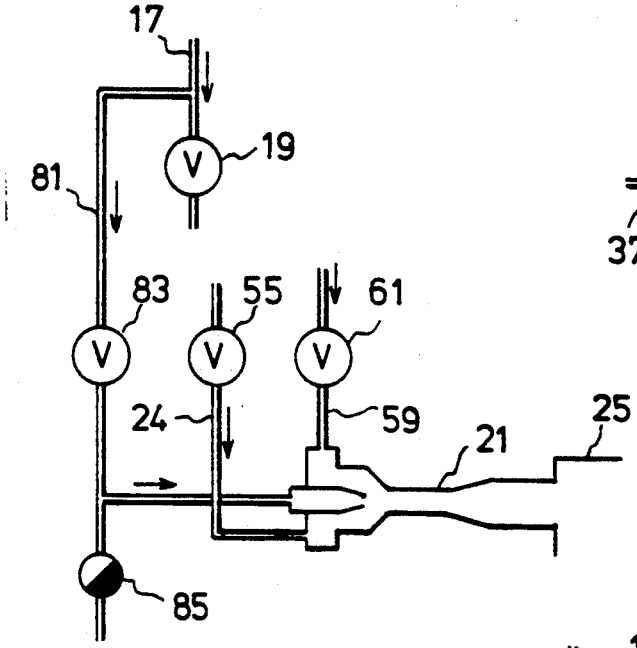
FIGS. 7 and 8 are partial views showing further variations of the embodiment of FIG. 2.

In the variation of FIG. 7, the gas exhaust piping 59 is connected to the suction chamber of the ejector 21, so that the ejector 21 serves two functions at the same time. In this case, the ejector 21 has its nozzle connected through a piping 81 having an automatic valve 83 to the steam supply piping 17 to be driven with high pressure steam, in order to raise its sucking power. A steam trap 85 is inserted in the piping 81 so as to remove condensed water.

Figure 8:
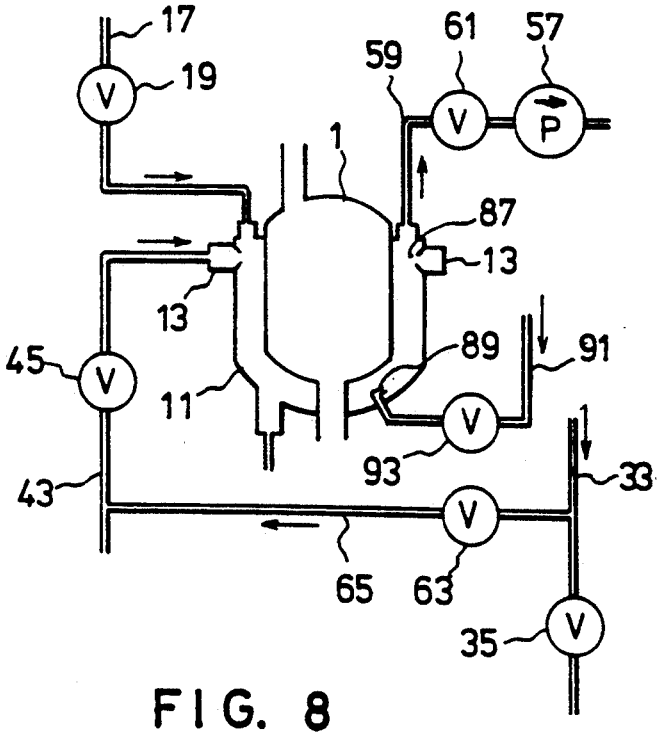

The variation of FIG. 8 shows an improvement of the heat exchanger 11. The inlet 13 of the heat exchanger 11 is provided with many nozzles 87 facing the side wall of the reaction vessel 1, so that cooling water is jetted against the side wall and caused to flow down uniformly along it to cool the vessel 1 efficiently. A nozzle 89 is also disposed in the lower portion of the heat exchanger 11 and connected to a compressed air supply (not shown) through a piping 91 having an automatic valve 93. The nozzle 89 serves to cause the air jetted therefrom to flow helically upwards within the heat exchanger 11 and be exhausted by the evacuation pump 57. With this structure, the temperature in the heat exchanger 11 is made uniform and any irregular cooling can be prevented.

The above description is given only for the purpose of illustration and does not mean any limitation to the invention. As a matter of course various modifications and changes can be added to the above embodiment and its variations without leaving the spirit and scope of the invention as defined in the appended claims. For example, the heat exchanger 11 is not limited to the jacket type as shown and may be of any type suitable for applying the invention. While ejectors are used as a preferred embodiment of the suction pump means for discharging liquids and gases, any type having a suitable sucking power may be used therefor. Although water and its vapor are used as the heat media, other known materials may be used in accordance with the treating conditions. Moreover, part of the automatic valves as shown may be manually operated, or appropriately omitted.

We claim:

1. A reduced pressure heat treating device comprising a heat exchanger having an inlet and an outlet for heat medium at upper and lower portions thereof, respectively, for effecting heat exchange with a product to be subjected to heat treatment, vapor producing means connected to said inlet for feeding vapor of said heat medium to said heat exchanger, first sucking means connected to said outlet for sucking said heat medium to put the interior of said heat exchanger in a reduced pressure state, a storage tank connected to said first sucking means for storing said heat medium, and pump means for feeding said heat medium from said storage tank to the inlet of said heat exchanger, said device further comprising:

second sucking means connected to the upper portion of said heat exchanger for sucking vapor of said heat medium produced in said heat exchanger to remove the same therefrom for promoting pressure reduction in said heat exchanger, said second sucking means comprising at least one ejector which is driven with output fluid of said pump means.

2. A reduced pressure heat treating device as setforth in claim 1, and further comprising:

said ejector having an outlet connected to said storage tank.

3. A reduced pressure heat treating device as set forth in claim 1, and further comprising:

an ejector common to both of said first and second sucking means.

4. A reduce pressure heat treating device as set forth in claim 1, wherein said heat exchanger further comprises:

a plurality of nozzles; and compressed air feeding means for agitating the heat medium in said heat exchanger.

* * * * *